US007695245B1

(12) United States Patent
Liang

(10) Patent No.: US 7,695,245 B1
(45) Date of Patent: Apr. 13, 2010

(54) TURBINE AIRFOIL WITH A MULTI-IMPINGEMENT COOLED SPAR AND SHELL

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 649 days.

(21) Appl. No.: 11/715,043

(22) Filed: Mar. 6, 2007

(51) Int. Cl.
*F01D 5/18* (2006.01)

(52) U.S. Cl. ..... 416/1; 416/97 R

(58) Field of Classification Search ..... 415/115; 416/96 A, 96 R, 97 R
See application file for complete search history.

(56) References Cited

U.S. PATENT DOCUMENTS 3,700,348 A * 10/1972 Corsmeier et al. ..... 416/90 R
3,715,170 A * 2/1973 Savage et al. ..... 416/97 R
4,473,336 A 9/1984 Coney et al.
4,563,128 A 1/1986 Rossmann
5,836,075 A * 11/1998 Fitzgerald et al. ..... 29/889.2
6,634,858 B2 * 10/2003 Roeloffs et al. ..... 416/97 R
7,080,971 B2 7/2006 Wilson et al.
7,270,517 B2 * 9/2007 Garner ..... 416/145

* cited by examiner

*Primary Examiner*—Edwark K. Look
*Assistant Examiner*—Ryan H Ellis
(74) *Attorney, Agent, or Firm*—John Ryznic

(57) ABSTRACT

A turbine airfoil of a gas turbine engine, the airfoil constructed from a spar and shell, in which the spar includes a root with a plurality of spar cooling air supply channels extending toward the tip and having impingement holes formed along the spar to provide impingement cooling to the shell, and the shell includes a plurality of shell return channels extending from the tip toward the root to channel the impingement cooling air to collector cavities located in the root. With a plurality of spar supply channels and shell return channels, a serpentine flow cooling circuit with multi-impingement cooling of the shell is produced. The cooling air supplied to the spar is discharged out exit holes in the trailing edge in one embodiment, or out exit holes and leading edge film cooling holes in a second embodiment. The spar and shell are bonded together using a low pressure and high temperature bonding process that includes thin sheets containing boron. The bonds are formed between the platforms and the joints between the return channels and the supply channels.

18 Claims, 4 Drawing Sheets

TURBINE AIRFOIL WITH A MULTI-IMPINGEMENT COOLED SPAR AND SHELL

BACKGROUND OF THE INVENTION

1. Field of the Invention

The present invention relates generally to fluid reaction surfaces, and more specifically to a turbine airfoil having a spar and shell construction with internal cooling.

2. Description of the Related Art including information disclosed under 37 CFR 1.97 and 1.98

As one skilled in the gas turbine technology recognizes, the efficiency of the engine is enhanced by operating the turbine at a higher temperature and by increasing the turbine's pressure ratio. Another feature that contributes to the efficiency of the engine is the ability to cool the turbine with a lesser amount of cooling air. The problem that prevents the turbine from being operated at a higher temperature is the limitation of the structural integrity of the turbine component parts that are jeopardized in its high temperature, hostile environment. Scientists and engineers have attempted to combat the structural integrity problem by utilizing internal cooling and selecting high temperature resistant materials. The problem associated with internal cooling is twofold. One, the cooling air that is utilized for the cooling comes from the compressor that has already extended energy to pressurize the air and the spent air in the turbine cooling process in essence is a deficit in engine efficiency. The second problem is that the cooling is through cooling passages and holes that are in the turbine blade or vane which, obviously, adversely affects the blade or vane's structural prowess. Because of the tortuous path (a serpentine path through the blade or vane) that is presented to the cooling air, the pressure drop that is a consequence thereof requires higher supply pressure and more air flow to perform the cooling that would otherwise take a lesser amount of air given the path becomes friendlier to the cooling air. While there are materials that are available and can operate at a higher temperature that is heretofore been used, the problem is how to harness these materials so that they can be used efficaciously in the turbine environment.

Also well known by those skilled in this technology is that the engine's efficiency increases as the pressure ratio of the turbine increases and the weight of the turbine decreases. Needless to say, these parameters have limitations. Increasing the speed of the turbine also increases the airfoil loading and, of course, satisfactory operation of the turbine is to stay within given airfoil loadings. The airfoil loadings are governed by the cross sectional area of the turbine multiplied by the velocity of the tip of the turbine squared, or $AN^2$. Obviously, the rotational speed of the turbine has a significant impact on the loadings.

One prior art reference, U.S. Pat. No. 7,080,971 B2 issued to Wilson et al. on Jul. 25, 2006 and entitled COOLED TURBINE SPAR AND SHELL BLADE CONSTRUCTION, discloses a spar/shell construction that affords the turbine engine designer the option of reducing the amount of cooling air that is required in any given engine design. And in addition, allowing the designer to fabricate the shell from exotic high temperature materials that heretofore could not be cast or forged to define the surface profile of the airfoil section. In other words, by virtue of this prior art turbine blade, the shell can be made from Niobium or Molybdenum or their alloys, where the shape is formed by a well known electric discharge process (EDM) or wire EDM process. In addition, because of the efficacious cooling scheme of this invention, the shell portion could be made from ceramics, or more conventional materials and still present an advantage to the designer because a lesser amount of cooling air would be required. The cooling arrangement in this Wilson et al. patent is a single impingement cooling circuit. The blade is formed of a single spar that provides a rigid support for the shell that forms the airfoil surface. The spar includes a single central cavity that forms the cooling air supply passage with impingement holes to direct impinging air against the inside surface of the spar wall.

It is an object of the present invention to provide for a turbine airfoil of the spar and shell construction in which the internal cooling circuit includes multiple impingement cooling of the airfoil.

It is another object of the present invention to provide for a turbine airfoil of the spar and shell construction in which the shell also forms part of the internal cooling channels.

BRIEF SUMMARY OF THE INVENTION

The present invention is a turbine blade with a spar and shell construction, in which the spar forms at least three cooling air channels with impingement holes to direct impinging cooling air against the shell inner wall surface for impingement cooling. The shell also includes return cooling air channels extending from the top and in between the cooling air channels in the spar. A serpentine flow cooling circuit is thus formed with the channels formed in the spar and the shell. In one embodiment, a five pass serpentine flow cooling circuit is formed with three up-pass channels formed in the spar and two down-pass channels formed in the shell. In another embodiment, a common up-pass channel in the spar is located in the middle of the blade, with a down-pass channel in the shell adjacent thereto and an up-pass channel in the spar on each of the leading edge and the trailing edge to form two three-pass serpentine flow cooling circuits. The cooling air exits the blade at the leading edge through film cooling holes and the trailing edge through exit cooling holes. The spar and shell is bonded together by a high temperature low pressure bonding process that uses a thin sheet containing boron.

DETAILED DESCRIPTION OF THE INVENTION

The present invention is described for a turbine blade used in a gas turbine engine, the blade having a spar and shell construction in which a spar extends from the root and forms a rigid support for a thin shell that forms the airfoil walls of the blade. However, the present invention is also intended for use in a stator vane for a gas turbine engine which is also exposed to the high temperature gas flow.

Figure 1:
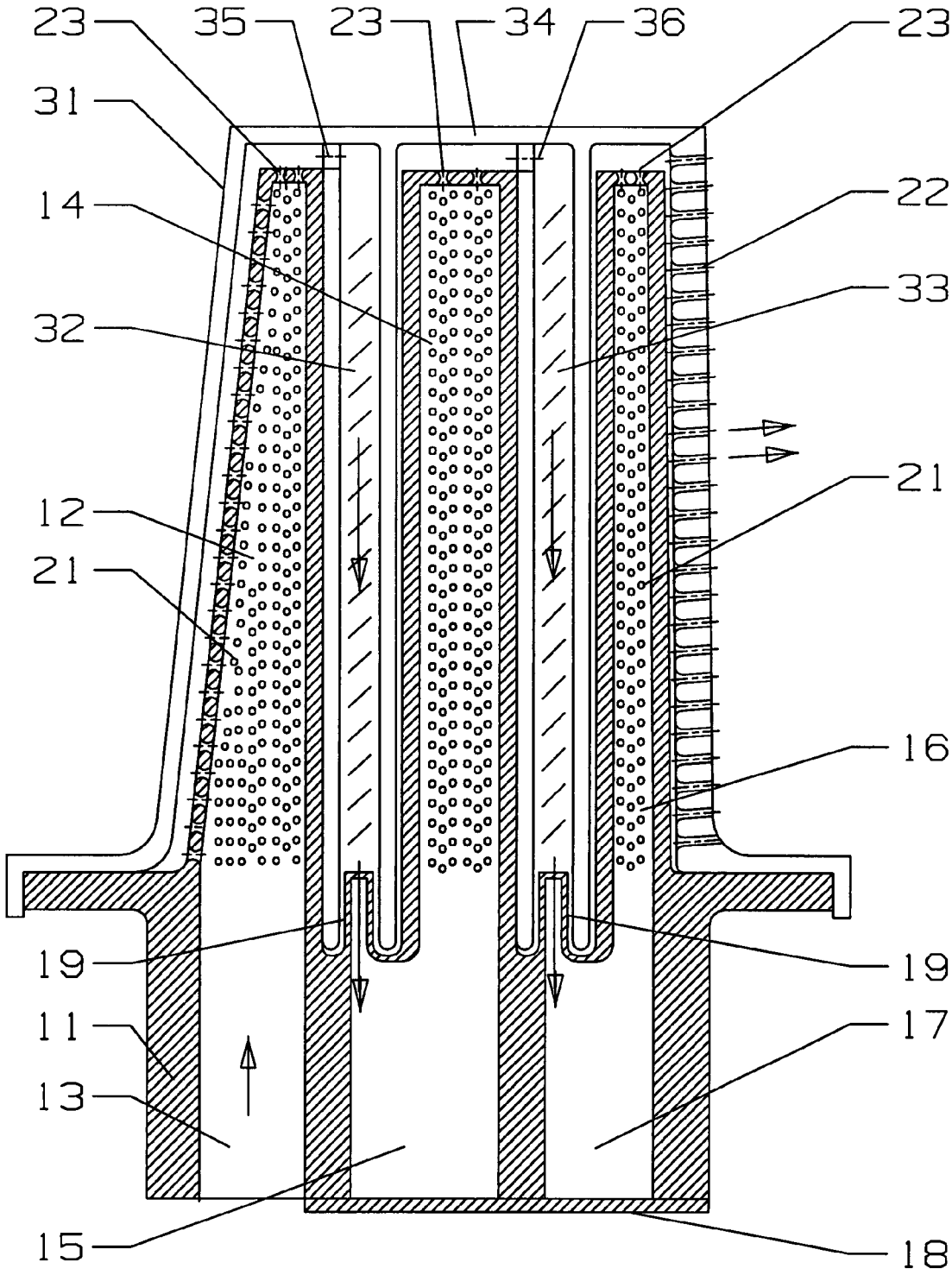
FIG. 1 shows a side view of a cross section of a turbine blade in the first embodiment of the present invention.
Figure 2:
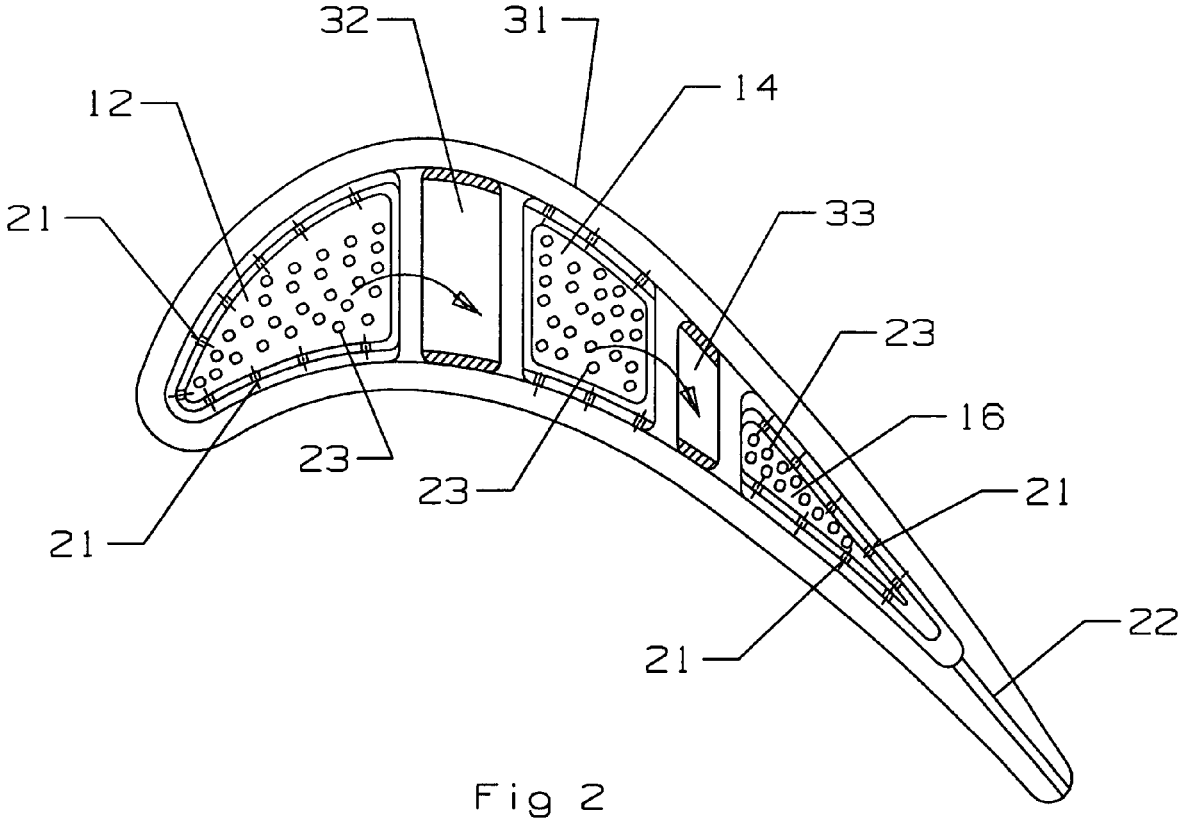
FIG. 2 shows a top view of a cross section of the blade of FIG. 1.

FIG. 1 shows a first embodiment of the turbine blade of the present invention. The blade includes a spar 11 with a root portion with three cavities and three spar extensions forming cooling air channels. A first spar 12 extends from a cooling air supply cavity 13 from the root and up to near the blade tip. A second spar 14 extends from a first collector cavity also to a point near the blade tip. A third spar 16 extends from a second collector cavity 17 up to near the blade tip. The first and second collector cavities 15 and 17 are covered by a cover plate. In each of the three spars 12, 14, and 16 are formed a plurality of impingement cooling holes 21 to direct impingement cooling air toward the shell wall on the pressure and suction sides. The first spar 12 also includes impingement holes 21 to direct impingement cooling air toward the leading edge of the blade as seen in FIGS. 1 and 2. Blade tip impingement cooling holes 23 are located on the ends of the spar cooling air supply channels 12, 14, and 16 to provide impingement cooling air to the underside of the shell on the blade tip.

A shell 31 that forms the blade airfoil surface is secured over the three spars to form the blade assembly. The shell 31 includes a piece that extends from the shell tip 34 toward the root that forms a first return cooling channel 32 and a piece that forms a second return cooling channel 33. A first crossover slot 35 and a second crossover slot 36 is formed in the shell to provide for a cooling air passage from the spar cooling channels. The first return cooling channel 32 opens into the first collector cavity 15 and the second return cooling channel 33 opens into the second collector cavity 17. Exit cooling holes 22 located in the trailing edge region of the blade are connected to the third spar cooling channel 16 through the impingement holes 21. Trip strips are included along the shell walls in the first and second return cooling air channels 32 and 33.

With the shell in place over the spars, the turbine blade of the first embodiment of FIGS. 1 and 2 operates as follows. Pressurized cooling air is supplied to the cooling air supply cavity 13 and up through the first cooling supply spar 12. most of the cooling air passing through the first spar 12 flows out the impingement holes 21 to provide impingement cooling to the leading edge, the pressure side and the suction side of the inner wall of the shell in the section of the first spar as seen in FIG. 2. The remaining cooling air in the first spar channel flows through the blade tip cooling holes 23. All of the cooling air from the first spar channel 12 then flows through the first crossover hole 35 and into the first return channel 32 formed in the shell and downward into the first collector cavity 15. Trip strips in the first return channel 32 enhance the cooling effectiveness of the flow.

The cooling air from the first collector cavity 15 then flows up into the second spar channel 14 and through the impingement cooling holes 21 and the blade tip cooling holes 23 and through the second crossover slot 36, and then down through the second return channel 33 and into the second collector cavity 17. From the second and last collector cavity 17, the cooling air flows up into the third spar channel 16 and through the impingement cooling holes 21 and the blade tip cooling holes 23. The cooling air then collects and flows out through the exit holes 22 in the trailing edge of the shell. In the first embodiment of FIGS. 1 and 2, all of the cooling air supplied into the cooling supply cavity 13 eventually flows out through the exit holes 22. In the first embodiment, the blade internal cooling circuit thus forms a five pass serpentine flow circuit, flowing through the channels 13,-32-14-33-16 in that order. The first leg of the serpentine flow cooling circuit is the first spar channel located along the leading edge of the blade where the external heat load is the highest. The spent cooling air from the spar channels and their respective impingement cooling holes flows into the return channels and the collector cavities to provide cooling for the airfoil shell.

Figure 3:
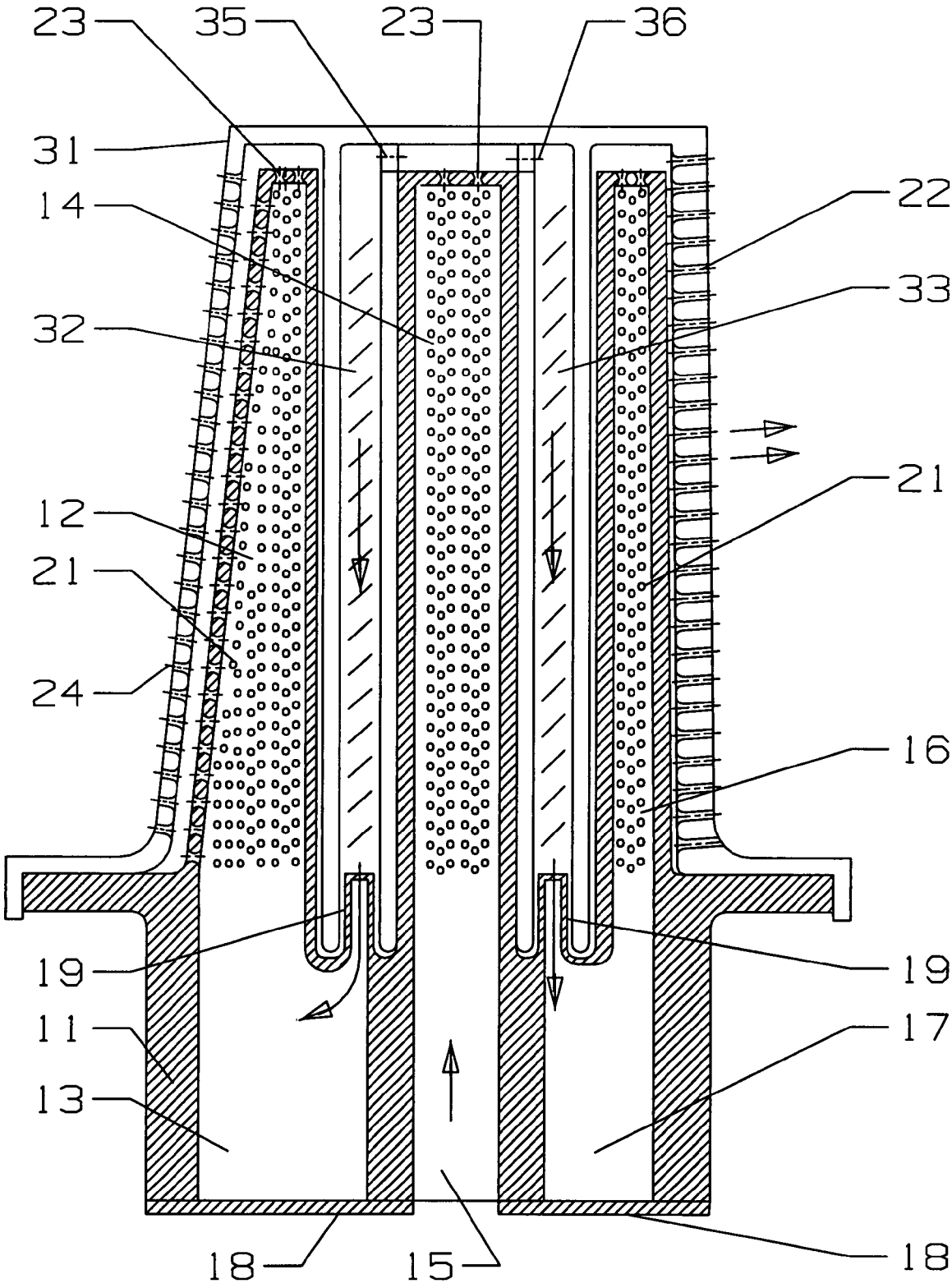
FIG. 3 shows a side view of a cross section of a turbine blade in the second embodiment of the present invention.
Figure 4:
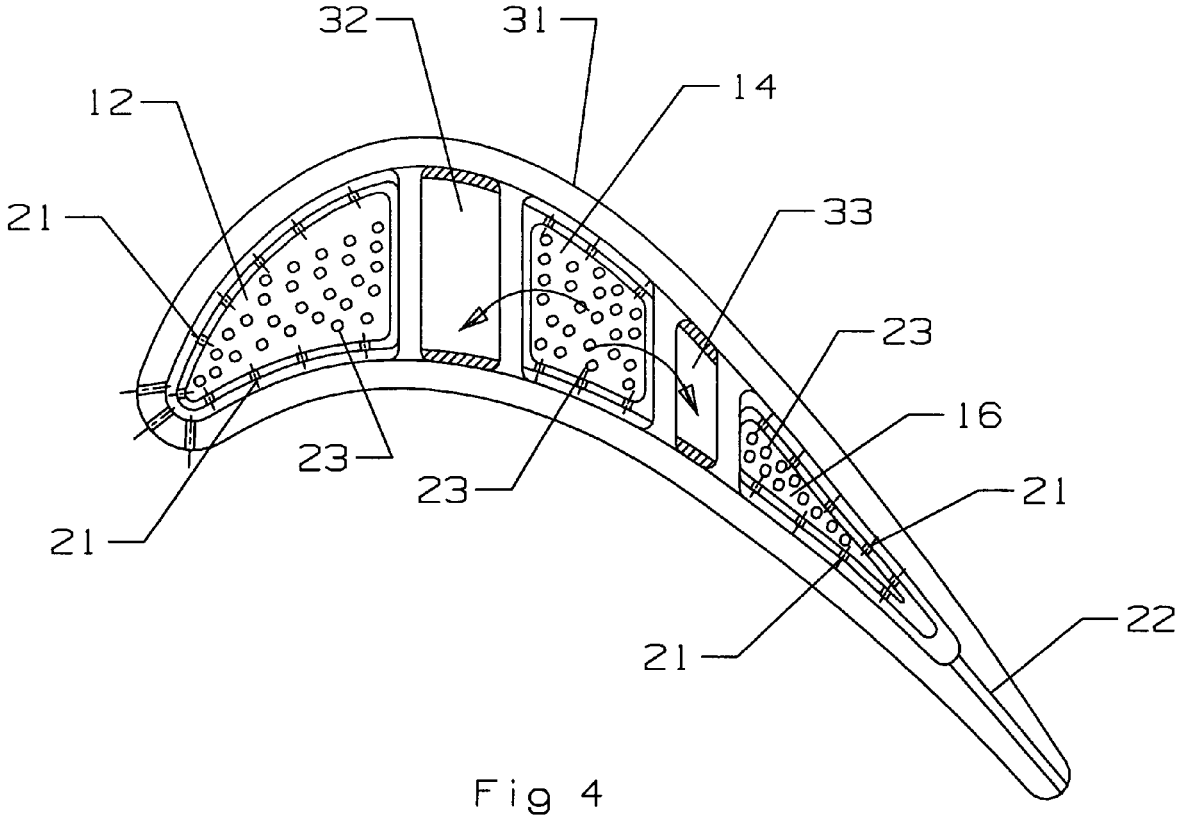
FIG. 4 shows a top view of a cross section of the blade of FIG. 3.

The second embodiment of the present invention is shown in FIGS. 3 and 4 and includes a spar 11 with the first spar channel 12, the second spar channel 14 and the third spar channel 16 extending from the spar root portion 11. the spar root 11 includes a cooling air supply cavity 15 in the middle of the first and second collector cavities 13 and 17, each of which are closed by cover plates 18. The spar channels 12, 14, and 16 each include impingement cooling holes 21 and blade tip cooling holes 23 as in the first embodiment.

The shell 31 in the second embodiment includes the first return channel 32 and the second return channel 33 extending from the tip toward the collector cavities 13 and 17. The shell also includes the first and second crossover slots 35 and 36 to connect the second spar channel 14 to the first and second return channels 32 and 33. the shell 31 includes the exit cooling holes 22 in the trailing edge as in the first embodiment, but unlike the first embodiment includes leading edge film cooling holes 24 to provide film cooling for the leading edge of the blade. Trip strips are also includes along the walls of the return channels 32 and 33 formed in the shell 31.

With the shell in place over the spars, the turbine blade of the second embodiment of FIGS. 3 and 4 operates as follows. Pressurized cooling air is supplied to the cooling supply cavity 15 and into the second spar channel 14, and then through the impingement cooling holes 21 and the blade tip cooling holes 23 associated with the second spar channel 14. The cooling air then divides and flows into one of the two crossover holes 35 and 36. Cooling air flow through the first crossover hole 35 then flows down the first return channel 32 in the shell and into the first collector cavity 13, and then up into the first spar channel 12. The cooling air in the first spar channel 12 flows through the impingement cooling holes 21 and the blade tip cooling holes 23 associated with the first spar channel 12, and then through the leading edge film cooling holes 24 and out from the blade. The cooling air from the second spar channel 14 that flows through the second crossover hole 36 flows down the second return channel 33 and into the second collector cavity 17, and then up the third spar channel 16 and through the impingement cooling holes 21 and the blade tip cooling holes 23 associated with the third spar channel 16. the cooling air then flows out through the exit cooling holes 22 spaced along the trailing edge of the shell and out from the blade. In the second embodiment, the internal cooling circuit is two parallel three pass serpentine flow circuits that share a common first leg. The two parallel three pass serpentine flow circuits are 21-32-12 and 21-33-16 with the first serpentine flow circuit discharging the cooling air through the leading edge film cooling holes 24, and the second serpentine flow circuit discharging the cooling air through the exit holes 22 in the trailing edge.

In both of the two embodiments above, the shell is bonded to the spar by placing a thin sheet of mostly boron composition with a thickness of about 1 mil to 2 mils and melting the boron sheet so that the two adjoining surfaces are bonded together. Bonds using this boron thin sheet process are created between the platforms and between the spar and shells parts that extend to form the passage in the return channels 32 and 33 and the projections 19 on the spar that lead into the collector cavities 15 and 17. the pressure acting on the boron sheets is due from the weight of the shell on the spar. Because the bonding pressure is substantially atmospheric pressure, the parts to be bonded do not deflect out of place in the bonding process. The turbine blade with the spar and shell construction and the multi-impingement cooling circuit provides the multi-impingement cooling arrangement for the airfoil, maximizes the usage of cooling air for a given inlet gas temperature and pressure profile. Also, the use of total cooling for repeating the impingement cooling process generates extremely high turbulence levels for a fixed amount of cooling flow, and therefore creates a high value of internal heat transfer coefficient. This yields a higher internal convective cooling effectiveness than does the prior art single pass impingement cooling circuit like that disclosed in the above cited Wilson et al. patent.

What is claimed is:

1. A turbine airfoil for use in a gas turbine engine, the turbine airfoil comprising:

a spar forming a rigid structure to support the airfoil;

a shell forming the airfoil surface with a leading edge and a trailing edge, and a pressure side and a suction side;

the spar including a cooling air supply channel extending from the root and through most of the shell; and, the shell including a cooling air return channel extending to the root and in fluid communication with the cooling air supply channel; and, the spar includes three spar cooling air supply channels and the shell includes two cooling air return channels.

2. The turbine airfoil of claim 1, and further comprising:

the spar supply channels and the shell return channels forming a five pass serpentine flow cooling circuit in which the first leg is the spar channel in the leading edge of the airfoil.

3. The turbine airfoil of claim 2, and further comprising:

the shell includes a plurality of exit holes along the trailing edge.

4. The turbine airfoil of claim 2, and further comprising:

the airfoil includes a root with a cooling supply cavity connected the first spar channel, a first collector cavity connecting the first shell return channel to the second spar supply channel, and a second collector cavity connecting the second shell return channel to the third spar supply channel.

5. The turbine airfoil of claim 1, and further comprising:

the spar supply channels and the shell return channels two parallel three pass serpentine flow circuits in which the middle spar supply channel forms the first leg for both of the two serpentine flow circuits.

6. The turbine airfoil of claim 5, and further comprising:

the shell includes a plurality of exit holes along the trailing edge and a plurality of film cooling holes along the leading edge.

7. The turbine airfoil of claim 5, and further comprising:

the airfoil includes a root with a cooling supply cavity connected the second spar channel, a first collector cavity connecting the first shell return channel to the first spar supply channel, and a second collector cavity connecting the second shell return channel to the third spar supply channel.

8. The turbine airfoil of claim 1, and further comprising:

the shell includes a crossover duct to connect the spar supply channel to the shell return channel.

9. The turbine airfoil of claim 1, and further comprising:

the spar supply channels each include a plurality of impingement cooling holes to provide impingement cooling air for the shell.

10. The turbine airfoil of claim 9, and further comprising:

The spar supply channels include blade tip impingement cooling holes on the ends of the spar channels to provide cooling for the shell tip.

11. The turbine airfoil of claim 1, and further comprising:

the shell is bonded to the spar by a thin sheet.

12. The turbine airfoil of claim 1, and further comprising:

a bond formed between the spar and the shell to hold the shell to the spar during operation.

13. The turbine airfoil of claim 12, and further comprising:

the bond is formed between the cooling air supply channel on the spar and the cooling air return channel on the shell.

14. The turbine airfoil of claim 13, and further comprising:

the bond also is formed between the platforms on the spar and the shell.

15. The turbine airfoil of claim 12, and further comprising:

the bond is a high temperature and low pressure bond so that the bonding parts do not displace.

16. A process for cooling a turbine airfoil having a spar and shell construction, the process comprising the steps of:

channeling cooling air through a first spar supply channel;

passing the cooling air through impingement holes to provide impingement cooling to the backside of the shell;

directing the impingement cooling air into a shell return channel; and, passing the impingement cooling air through the shell return channel;

collecting the cooling air from the shell return channel into a collecting cavity;

passing the collected cooling air through a second spar supply channel; and, passing the cooling air through impingement holes in the second spar supply channel to provide impingement cooling to the backside of the shell.

17. The process for cooling a turbine airfoil of claim 16, and further comprising the steps of:

collecting the impingement cooling air downstream from the second spar supply channel; and, discharging the cooling air through a series of exit holes in the trailing edge of the shell.

18. The process for cooling a turbine airfoil of claim 16, and further comprising the step of:

impingement cooling the shell tip with a portion of the cooling air passing through the first spar supply channel.

* * * * *